US007168690B2

(12) United States Patent
Grant

(10) Patent No.: US 7,168,690 B2
(45) Date of Patent: Jan. 30, 2007

(54) MULTIPLE CIRCUIT—SINGLE VALVE METERING SYSTEM FOR CARBURETOR

(76) Inventor: Barry S. Grant, Route 1, Box 1900, Dahlonega, GA (US) 30533

( * ) Notice: Subject to any disclaimer, the term of this patent is extended or adjusted under 35 U.S.C. 154(b) by 236 days.

(21) Appl. No.: 10/994,143

(22) Filed: Nov. 19, 2004

(65) Prior Publication Data

US 2005/0110170 A1 May 26, 2005

Related U.S. Application Data

(60) Provisional application No. 60/524,282, filed on Nov. 21, 2003.

(51) Int. Cl.
*F02M 19/06* (2006.01)
*F02M 19/10* (2006.01)

(52) U.S. Cl. ..... 261/23.2; 261/66; 261/DIG. 38

(58) Field of Classification Search ..... 261/23.2, 261/66, 67, 71, DIG. 12, DIG. 23, DIG. 38, 261/DIG. 56
See application file for complete search history.

(56) References Cited

U.S. PATENT DOCUMENTS

| | | | | | |
|---|---|---|---|---|---|
| 2,363,153 | A | * | 11/1944 | Shipman | 261/41.3 |
| 2,752,132 | A | * | 6/1956 | Nye | 261/23.2 |
| 2,867,422 | A | * | 1/1959 | Brunner | 261/23.2 |
| 2,973,947 | A | * | 3/1961 | Sterner | 261/23.2 |
| 3,030,085 | A | * | 4/1962 | Read | 261/41.1 |
| 3,454,264 | A | * | 7/1969 | Sarto | 261/23.2 |
| 3,677,526 | A | * | 7/1972 | Pierlot | 261/23.2 |
| 3,807,707 | A | * | 4/1974 | Johnson | 261/23.2 |
| 3,980,052 | A | * | 9/1976 | Noguchi et al. | 123/3 |
| 4,070,994 | A | * | 1/1978 | Garabedian | 123/242 |
| 4,363,308 | A | * | 12/1982 | Emmenthal et al. | 123/533 |
| 4,430,275 | A | * | 2/1984 | Horton | 261/18.3 |
| 4,502,435 | A | * | 3/1985 | Tadokoro et al. | 123/198 F |
| 5,283,011 | A | * | 2/1994 | McClintic et al. | 261/23.2 |
| 5,591,383 | A | * | 1/1997 | Krup | 261/34.1 |
| 5,693,262 | A | * | 12/1997 | Percival | 261/23.2 |
| 5,776,377 | A | * | 7/1998 | Hammel, Jr. | 261/23.2 |
| 5,809,972 | A | * | 9/1998 | Grant | 123/478 |
| 2005/0082694 | A1 | * | 4/2005 | Grant | 261/63 |

FOREIGN PATENT DOCUMENTS

| | | | | |
|---|---|---|---|---|
| JP | 54-126832 | * | 10/1979 | 261/23.2 |
| JP | 61-28745 | * | 2/1986 | 261/23.2 |

* cited by examiner

*Primary Examiner*—Richard L. Chiesa
(74) *Attorney, Agent, or Firm*—Thomas, Kayden, Horstemyer & Risley, LLP

(57) ABSTRACT

A carburetor for an internal combustion engine includes idle passages (22A and 22B) extending through the carburetor body adjacent each cylinder bore (18A–18-D) of the carburetor, such that the idle passages bypass the cylinder bores. A common fuel flow metering circuit (30) is in fluid communication with at least two of the idle passages for joining the fuel flowing from the idle passages and redistributing the fuel back to the idle passages. A metering valve (40) is positioned in the common fuel flow circuit for metering the flow of fuel through the common fuel flow metering circuit, so that equal distribution of the fuel is delivered to the cylinders of the engine in spite of possible unequal flow of fuel being received through the idle passages.

4 Claims, 3 Drawing Sheets

MULTIPLE CIRCUIT—SINGLE VALVE METERING SYSTEM FOR CARBURETOR

CROSS REFERENCE

This application claims the benefit of provisional U.S. patent application 60/524,282 filed Nov. 21, 2003 now abandoned.

FIELD OF THE INVENTION

This invention concerns carburetors for internal combustion engines, particularly the means for balancing and adjusting the volume of fuel moving through the idle well of the carburetor toward the engine.

BACKGROUND OF THE INVENTION

Carburetors for internal combustion engines typically include venturi passages for the passage of air from the atmosphere to the engine, with the venturi passages being used to create a zone of low pressure that induces flow of fuel into the stream of air. Butterfly valves are used to variably constrict, and therefore control, the volume of air passed through the bores of the carburetor.

In addition, most carburetors include other passages that are not controlled by the butterfly valves but are controlled by needle valves or other constriction means that can be set and are not variable during the normal operation of the carburetor. A purpose of one of these additional fuel passages is to continue to pass smaller amounts of fuel and air through the carburetor to the engine so as to allow the engine to idle at slow speeds.

Typically, in a four barrel carburetor there will be four idle passages, and each idle passage will have its own needle valve or other means for constricting the flow of fuel and air passing there through.

A typical problem with the prior art designs is that it is difficult to adjust the volume of fuel that moves through each idle passage. Typically, the technician will attempt to adjust all of the valves so that the flow of fuel and air through all of the idle passages is equal. This tends to balance the volume of fuel and air to each cylinder of the engine. If the valves that control the flow of fuel throughout the idle passages are not equally adjusted, some cylinders will receive more fuel than others, resulting in non-uniform or "rough" engine performance during idling.

SUMMARY OF THE INVENTION

Briefly described, the present invention comprises a carburetor for an internal combustion engine that includes a carburetor body that defines a plurality of cylinder bores for the passage of streams of air from the atmosphere to the engine. Each cylinder bore has a venturi constriction for reducing the pressure of air as the air passes through the cylinder bore, and for drawing fuel from the fuel bowl into the stream of air passed through the cylinder bore, and a valve in alignment with each cylinder bore configured for variably constricting the flow of air through the cylinder bore. An idle passage extending through the carburetor body adjacent each cylinder bore bypasses the valves of the carburetor cylinder bores and is configured for passing fuel from the fuel bowl to the engine without regulation by the valves of the cylinder bores.

A common fuel metering circuit is in fluid communication with at least two of the idle passages, joining the fuel flowing from the idle passages and redistributing the fuel back to the idle passages. A metering valve is positioned in the common fuel flow metering circuit for metering the flow of fuel through the common fuel flow metering circuit. The fuel passing through the two idle passages join to the common fuel flow metering circuit is passed through the metering valve and is redistributed back to the idle passages, such that the volume of fuel being passed through both idle passages is substantially equal over a given time interval.

BRIEF DESCRIPTION

Figure 1:
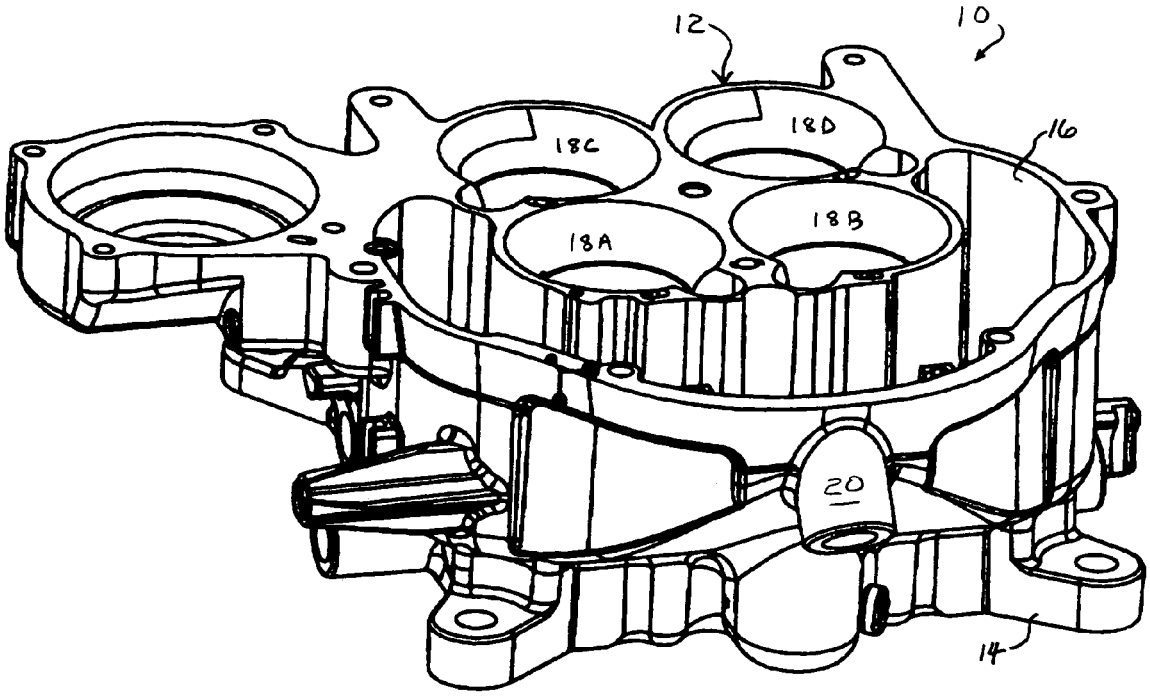
FIG. 1 is a perspective view of a carburetor that embodies the invention.

Referring now in more detail to the drawings, in which like numerals indicate like parts throughout the several views, FIG. 1 illustrates a carburetor 10 that includes a carburetor body 12. The carburetor body includes its own base 14 and a semi-circular fuel bowl 16 integrally connected within the body. A plurality of cylinder bores are formed in and extend through the carburetor body. In the example of the invention disclosed herein, there are four cylinder bores, 18A, 18B, 18C and 18D, arranged in a rectangular array. This invention can be used with carburetors having a different number of cylinder bores and with the cylinder bores arranged in different configurations.

Each cylinder bore 18A–18D includes an internal venturi surface of the type that converges from top to the intermediate portion and then diverges from the intermediate portion to the exit, so as to accelerate the velocity of the air stream, and then to open the passage to a wider cross-sectional area so as to create the vacuum necessary to draw fuel into the air stream. This is conventional in the art.

Fuel that is to be delivered to the carburetor comes from a storage tank, is pumped from the storage tank by a fuel pump and passes through a fuel pressure regulator (not shown) and is delivered to the fuel bowl 16 through the fuel inlet port 20. The float valve (not shown) maintains the level of the fuel in the fuel bowl at a desired position so as to be available for induction into the air stream moving through the carburetor.

Figure 2:
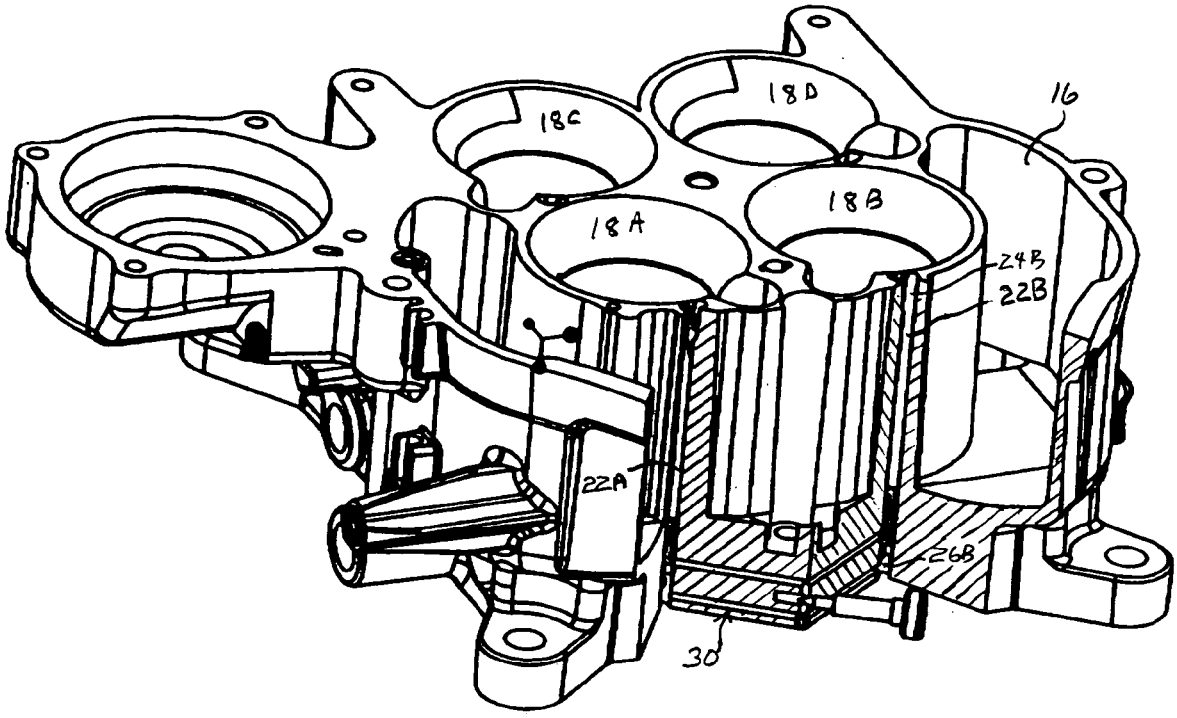
FIG. 2 is a perspective illustration of the carburetor of FIG. 1, with parts removed for illustrating the internal components thereof.

FIG. 2 illustrates the carburetor of FIG. 1, with portions of the fuel bowl and the internal portion of the carburetor body removed so as to illustrate internal features of the carburetor. Idle passages such as idle passages 22A and 22B are formed through the carburetor body 12 adjacent each cylinder bore 18A–18D. Each idle passage includes an upper fuel inlet portion such as fuel inlet portion 24B, and a lower fuel delivery portion, such as fuel delivery portion 26B. The idle passages bypass the cylinder bores 18A–18D and their venturi surfaces, and also bypass the control valve (not shown) that is positioned in alignment with the cylinder bores. The idle passages allow fuel to move from the fuel bowl 16 downwardly into the fuel inlet portion 24 of each idle passage and then downwardly through fuel delivery portion 26 thereof. However, a plug 28 is positioned between the fuel inlet portion 24 and the fuel delivery portion 26, as will be explained hereinafter.

A common fuel flow metering circuit 30 is positioned in fluid communication with adjacent ones of the idle passages 22A and 22B.

Figure 3:
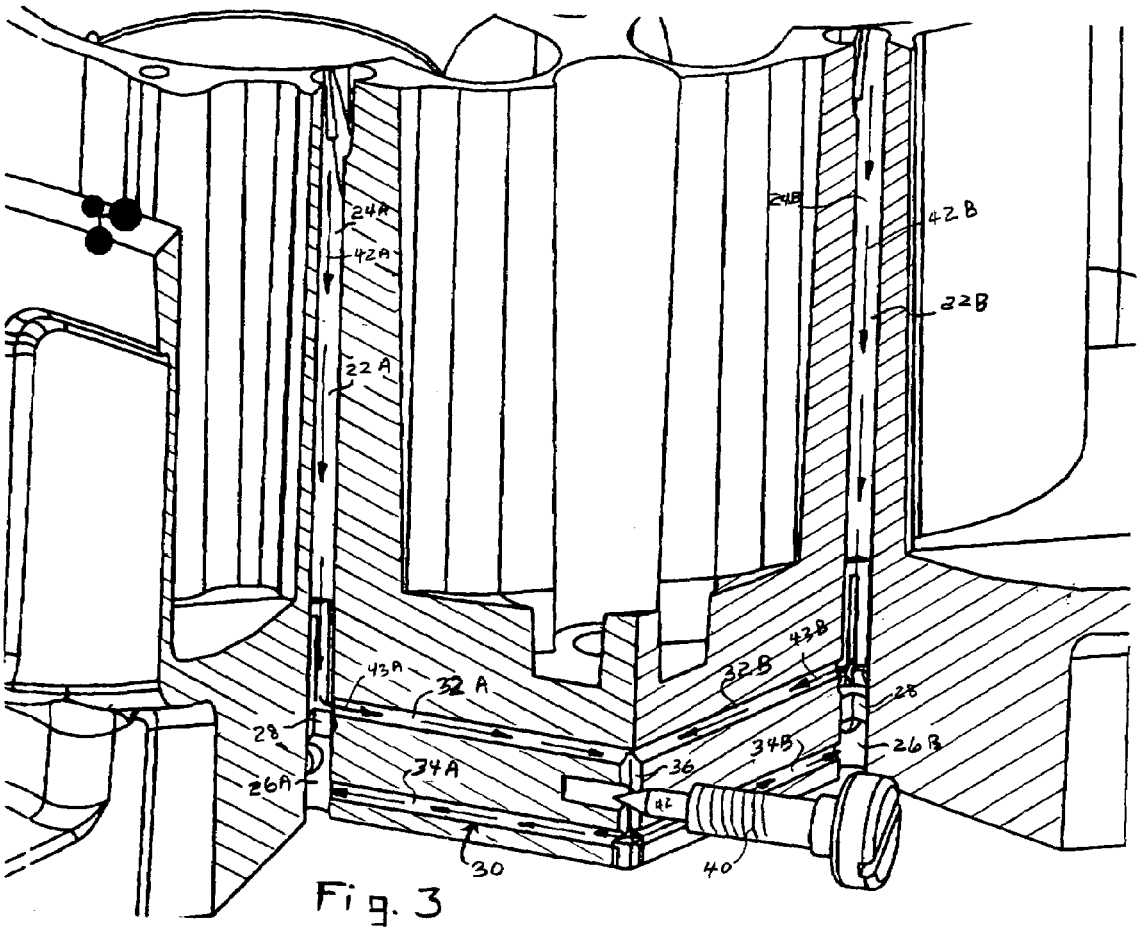
FIG. 3 is a close up perspective view of the carburetor of FIGS. 1 and 2.

As shown in FIG. 3, the common fuel flow metering circuit 30 includes a fuel inlet branch for each idle passage, such as fuel inlet branch 32A that is in fluid communication with fuel inlet portion 24A of idle passage 22A, and a fuel distribution branch 34A that is in fluid communication with fuel delivery portion 26 of the idle passage 22A. A similar arrangement is formed for the fuel inlet branch 32B and fuel distribution branch 34B that are in fluid communication with the fuel inlet portion 24B and fuel delivery portion 26B of the idle passage 22B.

Common passage 36 is shown as being vertically oriented, with an upper end that communicates with both fuel inlet branches 32A and 32B and with a lower end portion that communicates with fuel distribution branches 34A and 34B. A needle valve 40 is threaded into the carburetor body (not shown), with its distal end intersecting the common passage 36, so that when the needle valve is rotated, its spiral threads that engage the carburetor body move the valve stem 42 into or out of the common passage 36, thereby constricting or opening the common passage, and thereby adjusting the flow of fluid through the common fuel flow metering circuit 30.

While the fuel inlet portion 24 and fuel delivery portion 26 of the idle passages are shown as a single bore in the carburetor body, the plug 28 is positioned therein so as to divide the fuel inlet portion from the fuel delivery portion. The plug requires the fuel to flow in the directions as indicated by the arrows shown in FIG. 3. The arrows 42B show the downward movement of the fuel through the fuel inlet portion 24B of the idle passage 22B, then the fuel is diverted as indicated by arrows 43B through the fuel inlet branch 32B, then through the common passage 36, about the needle valve 40, then back through the fuel distribution branches 34A and 34B, and then out of the fuel delivery ports 26A and 26B. Likewise, the arrows 42A and 43A show the flow of fuel through the fuel inlet portion 24A of idle passage 22A, then the fuel is diverted as shown by arrow 43A through the fuel inlet branch 32A, through the common passage 36 where it is adjustably constricted by the needle valve 40, then back through the fuel distribution branches 34A and 34B, and then out of the carburetor body to the cylinders of the engine.

With this arrangement, the single needle valve 40 is used to adjust the flow of fuel through the adjacent idle passages 22A and 22B of the carburetor body when the vehicle is to idle. By moving the fuel from both idle passages through the common fuel flow metering circuit, the fuel distribution branches 34A and 34B receive equal flows of fuel. Also, by changing the depth of penetration of the needle valve 40 in the common passages 36 of the common fuel flow metering circuit 30, the flow of fuel will be equally increased or increased at the fuel distribution branches 34A and 34B, in spite of the possible unequal delivery of fuel to the fuel inlet portions 24A and 24B of the idle passages 22A and 22B.

While the common fuel flow metering circuit is described and illustrated as a circuit that receives fuel from and delivers fuel back to the same idle passages, it should be understood that the common fuel flow metering circuit can be arranged to deliver the fuel in separate fuel delivery ports.

While the valve described and illustrated is a needle valve it will be understood that other types of fluid constrictions may be used.

Although a preferred embodiment of the invention has been disclosed in detail herein, it will be obvious to those skilled in the art that variations and modifications of the disclosed embodiment can be made without departing from the spirit and scope of the invention as set forth in the following claims.

The invention claimed is:

1. A carburetor for an internal combustion engine, comprising:

a carburetor body defining a plurality of cylinder bores for the passage of streams of air from the atmosphere to the engine, each cylinder bore having a venturi constriction for reducing the pressure of air as the air passes through the cylinder bore and for drawing fuel from a fuel bowl into the stream of air passed through the cylinder bore, and a valve in alignment with each cylinder bore configured for variably constricting the flow of air through the cylinder bore, an idle passage extending through the carburetor body adjacent each cylinder bore that bypasses said valves and configured for the passing of fuel from the fuel bowl to the engine without regulation by said valves, the improvement therein comprising:

a common fuel flow metering circuit in fluid communication with at least two of said idle passages joining the fuel flowing from the idle passages and re-distributing the metered fuel back to said idle passages and a metering valve in said common fuel flow metering circuit for metering the flow of fuel through said common fuel flow metering circuit, such that fuel passing through the at least two of said idle passages is passed through the metering valve and redistributed back to the idle passages.

2. The carburetor of claim 1, wherein said metering valve is a needle valve.

3. The carburetor of claim 1, wherein said carburetor body defines four cylinder bores.

4. The carburetor of claim 1, wherein said idle passages each include a fuel inlet portion and a fuel delivery portion, and said common fuel flow metering circuit has an inlet branch in communication with the fuel inlet portion and a distribution branch in communication with the fuel delivery portion.

* * * * *